United States Patent [19]

Grantham

[11] Patent Number: 4,787,104

[45] Date of Patent: Nov. 29, 1988

[54] CONVERTIBLE HOSPITAL BED

[76] Inventor: Frederick W. Grantham, 12055 Goshen Ave., Los Angeles, Calif. 90049

[21] Appl. No.: 662,355

[22] Filed: Oct. 18, 1984

[51] Int. Cl.[4] ..... A61G 7/06

[52] U.S. Cl. ..... 5/66; 5/67; 5/69; 5/81 C

[58] Field of Search ..... 5/60–73, 5/74 R, 74 B–80, 81 R, 81 B, 81 C, 82 R, 82 B, 423, 506

[56] References Cited

U.S. PATENT DOCUMENTS

| | | | |
|---|---|---|---|
| 2,560,349 | 7/1951 | Inglis | 5/423 |
| 2,656,876 | 10/1953 | Larrick | 5/66 |
| 3,444,922 | 5/1969 | Dingman | 5/423 |
| 3,503,082 | 3/1970 | Kerwit | 5/66 |
| 3,729,751 | 5/1973 | Kirkman | 5/66 |
| 3,797,052 | 3/1974 | Licina et al. | 5/64 |
| 4,127,906 | 12/1978 | Zur | 5/66 |
| 4,227,269 | 10/1980 | Johnson | 5/66 |
| 4,274,167 | 6/1981 | Inmel | 5/66 |
| 4,472,845 | 9/1984 | Chivetta et al. | 5/66 |
| 4,472,846 | 9/1984 | Volk et al. | 5/66 |

*Primary Examiner*—Gary L. Smith
*Assistant Examiner*—Vinh Luong
*Attorney, Agent, or Firm*—Henry M. Bissell

[57] ABSTRACT

An institutional bed, such as is commonly used in hospitals and nursing homes, which is convertible into an easy chair. Conversion occurs by moving an upper frame and the mattress longitudinally toward the foot of the bed while elevating the upper body portion of the movable frame to form the back of the chair. As the frame moves toward the foot, the lower portion, together with the portion of the mattress thereon, is drawn back underneath the bed and out of the way from interfering with the patient sitting in the chair configuration with his feet on the floor. The chair configuration may be elevated so that the patient is assisted in rising to a standing position without dependence upon attendant personnal. The bed includes an inflatable pillow which further assists the patient in rising unaided. Other features of the bed include spinal massage apparatus mounted in the main frame of the bed, independent elevating apparatus for selectively elevating the foot of the bed, relative to the head in order to slant the bed or alternately elevating and lowering the head and foot of the bed to develop a rocking motion, and a motorized blower for directing air to a porous coverlet to supply heat or cooling to the patient without resort to electrical wiring, as in an electric blanket, or to multiple covers for warmth. All of the various apparatus providing these features of the bed are power driven and are controlled from a remote console which is accessible to the patient.

23 Claims, 4 Drawing Sheets

CONVERTIBLE HOSPITAL BED

BACKGROUND OF THE INVENTION

1. Field of the Invention

This invention relates to beds and, more particularly, to beds of the so-called "hospital" type, being particularly designed for use in hospitals and nursing homes or for residential use with patients who are possibly ambulatory but are too weak or incapacitated to get into or out of bed without assistance.

2. Description of the Prior Art

Bed patients, whether in a hospital or nursing home or even at home, are not infrequently in a physical condition where they can move about by themselves—for example, to go to the bathroom or take short walks, with or without assistance—but lack the strength to lift themselves out of bed unaided. Not infrequently, such patients are obese or at least represent a nearly deadweight load of 200 to 300 pounds. Attempting to assist such a patient to get out of bed and assume a standing position requires substantial strength on the part of an assisting nurse or orderly. Such personnel are often faced with the problem of over-exerting themselves in assisting such a patient, and backstrain is a common complaint among nurses for this reason. An alternative is for the nurse to call upon stronger male orderlies to help, but they may not be readily available at the very point in time when the patient needs to get out of bed to go to the bathroom.

There are various examples in the known prior art of attempts to solve the problem of repositioning patients in a bed or on some other supporting surface and in transferring patients between a bed and a cart or gurney for transporting to some other area of the patient care facility, as for the taking of X-rays, for surgery, etc.

U.S. Pat. No. 3,810,263 of Taylor et al is directed to a medical examining table which includes a conveyor belt for moving a patient longitudinally of the table to facilitate locating the patient in various examining positions as selected by the doctor. The table includes a hinged portion which can be raised to help the patient get off the table and also discloses a mechanism for feeding paper or other sheet material along the table, as is customary to provide a clean resting surface for each successive patient.

U.S. Pat. Nos. 3,854,152 of Chez and 3,871,036 of Attenburrow disclose apparatus for transferring patients between a bed and an adjacent cart or gurney. A movable belt is employed to slide under the patient and effect the transfer operation. The Chez patent describes a pair of endless belts which gently grasp the patient and transfer the patient to an upper belt.

U.S. Pat. No. 3,886,610 of Sheldon discloses a hospital bed incorporating a plurality of individual laterally-directed bolsters connected to a longitudinal drive belt and used to reposition a seriously ill patient in an intensive care unit longitudinally of the bed in which the head section is cranked up to raise the patient's head and shoulders, the purpose being to counteract the tendency of the patient to gradually slide downwardly toward the foot of the bed because of the elevated position of the upper part of the body. As the bolsters are moved toward the head of the bed, the leading bolster can be removed and placed at the foot to maintain the extent of the mattress portion as the patient gradually slides relative to the bolsters.

U.S. Pat. No. 3,936,893 of Anderson et al discloses a convertible wheel chair and bed with an elevator mechanism for raising and lowering the support surface between the upper level desired for a hospital bed and the lower level desired for wheel chair height.

The known prior art does not address itself to applicant's concept of converting a hospital bed to an armchair by raising the back portion and translating the mattress toward the foot of the bed to form a structure which supports a patient in a sitting position with feet on the floor and, further, to elevate the thus-formed chair to assist the patient in gradually assuming a standing position without the need for assistance from attending personnel.

SUMMARY OF THE INVENTION

In brief, arrangements in accordance with the present invention incorporate a patient support frame which is movable longitudinally of the bed proper. This frame includes the bed spring on which the mattress is placed to support the patient in conventional reclining position. The movable frame comprises two major portions, an upper body support portion which is pivotably connected to the lower body support portion. The bed includes a mechanism for elevating the upper body support portion so that it pivots relative to the bed to assume an attitude corresponding to the backrest of a chair. Another drive mechanism associated with the bed is operable to move the bed frame longitudinally toward the foot of the bed. In accordance with an aspect of the invention, the lower body portion of the movable frame comprises a plurality of transverse slats, linked by a flexible chain which is drawn around a roller at the foot of the bed so that, as successive slats of the lower body portion reach the foot of the bed, they are drawn back underneath the foot of the bed, together with the lower portion of the mattress which rests thereon. Eventually, as the movable frame reaches a limit position adjacent the foot of the bed, the patient is supported in a sitting position with his feet extending downward from the foot of the bed toward the floor. A pair of arm rests are mounted on the bedposts at the foot of the bed to complete the converted chair. When the device is being used as an armchair, a standard wheeled table having a cantilevered horizontal frame member, such as is used in hospitals to serve as a table for bed patients, can be wheeled into position over the patient's lap to provide a surface for permitting the patient to write, read a book or eat his meals from.

The drive mechanisms for converting the device between chair and bed are selectively actuable from a switch console extending from an electrical cable for access to the patient or to attendant personnel. In accordance with a further aspect of the invention, the console includes a control switch for actuating a drive arrangement installed in the bed for gradually raising the converted chair portion at the foot of the bed to a level where the patient can easily assume a standing position. Thus, a bed patient who is without the strength to arise unaided from a sitting to a standing position and who would find it impossible to rotate his body and get out of bed from the side without assistance is often able to assume the standing position without the aid of attendants by virtue of exercising the features of the present invention. The actions of the patient getting into bed are facilitated in similar fashion wherein the patient seats himself gently in the raised chair configuration, then lowers the foot of the bed to conventional chair height, after which he may convert the device back into the bed configuration wherein the support frame is in the conventional position extending between the head and foot of the bed.

Arrangements in accordance with the present invention may include additional features which have been found to be desirable in a device of this type. In accordance with one further aspect of the invention, a pair of laterally extending rollers, offset in a plane from a central, laterally extending, support shaft, are mounted in conjunction with a selectively operable driving mechanism so as to be rotatable about the axis of the central support shaft. This shaft and roller combination is mounted in a frame which is movable longitudinally between the positions of the patient's hips and shoulders. Thus, when actuated, the associated driving mechanism moves the frame slowly back and forth while the rollers are rotated about their associated support shaft to massage the patient's back through the spring and mattress. This arrangement includes a cam device which assures that the plane of the two rollers is generally horizontal when the associated driving mechanism is deactivated, thereby "parking" the rollers out of contact with the mattress.

In accordance with a further aspect of the invention, the convertible hospital bed may be equipped with a selectively operable blower and heater which may be coupled to an inflatable coverlet having a porous underside to distribute air, either ambient or heated, to the region of the patient's body, thereby enabling the patient to be warmed in bed without the need for heavy blankets or an electric blanket. Such a coverlet can be extremely lightweight, in the nature of a bed sheet, and made of material which is readily washable, thereby enabling the hospital or other facility to provide improved sanitary conditions for a patient by avoiding resort to bed blankets which are customarily not cleaned from one patient to another, as are the usual bed sheets.

In accordance with still another aspect of the invention, the convertible hospital bed may incorporate an inflatable pillow mounted in the lower body portion of the removable frame and an associated air compressor, selectively controllable from the control console, to inflate the pillow, either for the purpose of raising the patient's legs slightly when the patient is reclining in the bed or, alternatively, to support the patient in a more comfortable position when he is seated in the chair configuration. This pillow may also be inflated as the patient is rising from the chair configuration to assist the patient at that point.

Other features which may be incorporated in the convertible bed of the present invention include drive mechanisms, controllable from the control console, which raise or lower the bed, which cause the bed to slant with the feet higher than the head, and which cause the bed to rock slowly from head to foot, a movement which some patients find to be an aid in getting to sleep.

BRIEF DESCRIPTION OF THE DRAWING

A better understanding of the present invention may be had from a consideration from the following detailed description, taken in conjunction with the accompanying drawing in which.

DESCRIPTION OF THE PREFERRED EMBODIMENTS

Figure 1:
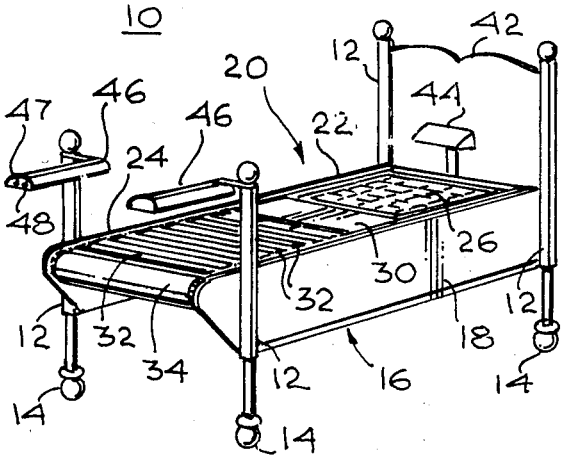
FIG. 1 is a perspective view of a convertible hospital bed in accordance with the present invention.
Figure 2:
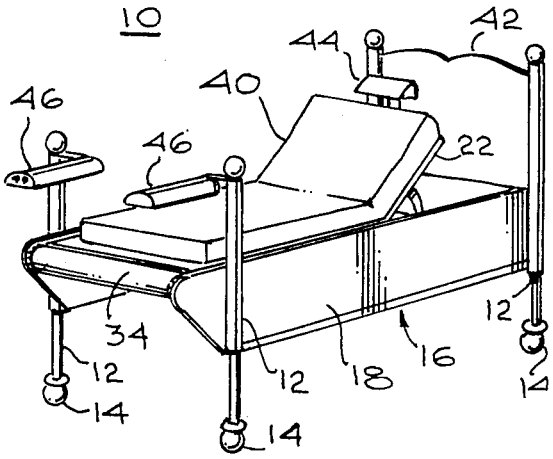
FIG. 2 is a similar view showing the upper body portion of the bed in a partially elevated position.

In FIGS. 1 and 2, a convertible bed 10 of the present invention is shown in a typical hospital bed configuration. It is supported on four legs 12, each having a corresponding caster or wheel 14 for ease in moving the bed about a room. The legs 12 are telescoping, the upper portion being slidable up and down by conventional mechanisms so that the bed may be raised or lower as desired. In accordance with an aspect of the present invention, separate mechanisms are provided for the two legs at the head and the two legs at the foot so that the head and foot can be raised or lowered independently of each other.

The convertible bed 10 essentially comprises a lower main frame 16, concealed behind side panels 18, and an upper movable frame 20 which includes an upper body portion 22 and lower body portion 24. The upper body portion 22 includes a spring 26 and is pivotably joined to the lower body portion so that it may be elevated, as shown in FIG. 2 in the bed configuration, or to an almost vertical orientation when converted into the chair configuration, as shown in FIGS. 3–5.

Figure 6:
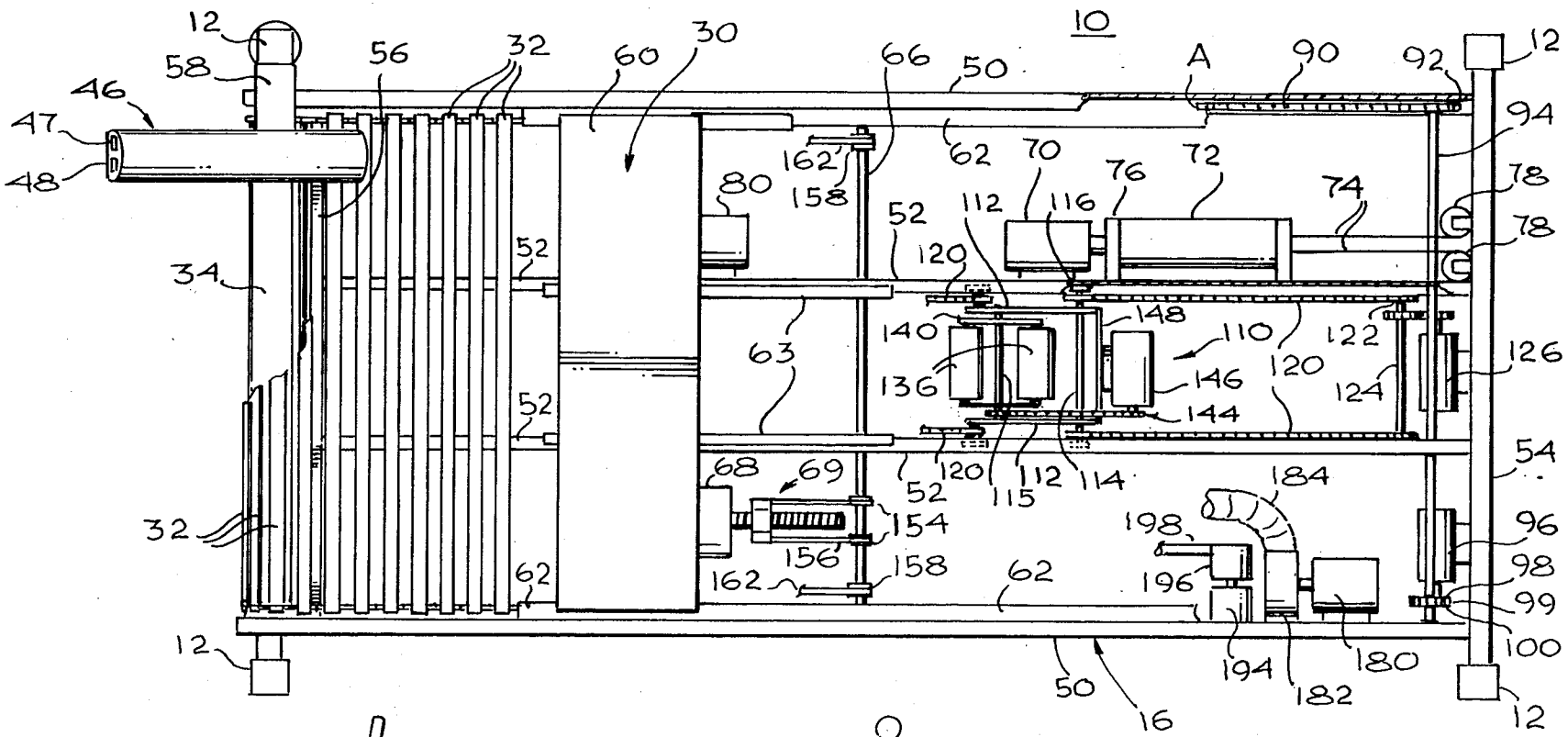
FIG. 6 is a plan view of the convertible bed of FIG. 1, showing particular details thereof.
Figure 7:
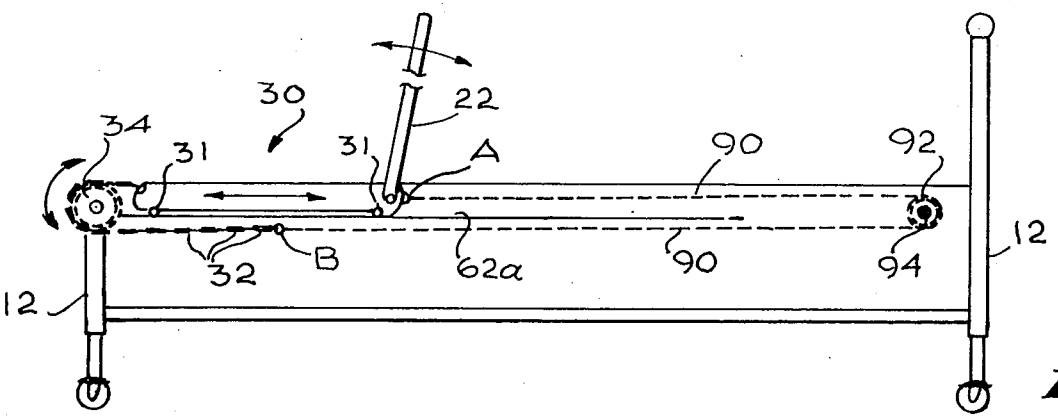
FIG. 7 is a schematic side elevation illustrating the conversion between bed and chair configurations.

The lower body portion 24 includes a movable carriage 30, to which the upper body portion 26 is attached, and a plurality of transverse slats 32, the carriage 30 and slats 32 being linked together at opposite sides of the bed by a pair of longitudinally extending sprocket chains (illustrated in FIGS. 6 and 7). A cylindrical roller 34 extends transversely of the bed adjacent the foot and provides surfaces for guiding the slats 32 and associated drive chains during longitudinal movement of the upper frame 20 in converting the apparatus between the bed and chair configurations. During conversion from the bed configuration as shown in FIGS. 1 and 2 to the chair configuration, shown in FIG. 3, the driving chains draw the slats 32 over the roller 34 and back underneath the main frame between the side panels 18. The foot portion of the mattress 40 and undersheet positioned thereon are also drawn back under the main frame of the bed during conversion to the chair configuration.

The convertible bed 10 also includes a headboard 42 extending between the pair of legs 12 at the head of the bed, a reading lamp 44 which is mounted on the upper body portion 22 of the main frame 20 and a pair of arm rests 46 which are mounted on the two legs 12 at the foot of the bed. A pair of switches 47, 48 are provided in one of the arm rests 46 (see FIG. 1) for controlling up and down movement of the chair. The arm rests are mounted in a manner which permits them to be easily removed, merely by lifting them out of their releasable support brackets. If desired, they may be pivotably mounted to swing out of the way when not needed as arm rests for the chair configuration.

Figure 3:
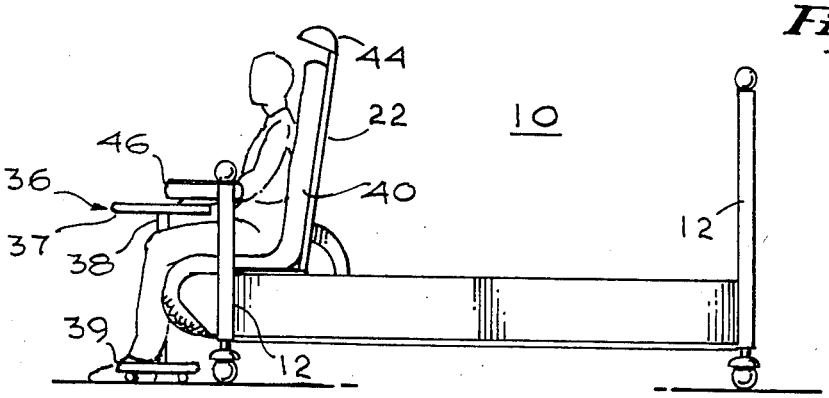
FIG. 3 is a side elevational view of the bed of FIG. 1 showing it converted to a chair.
Figure 4:
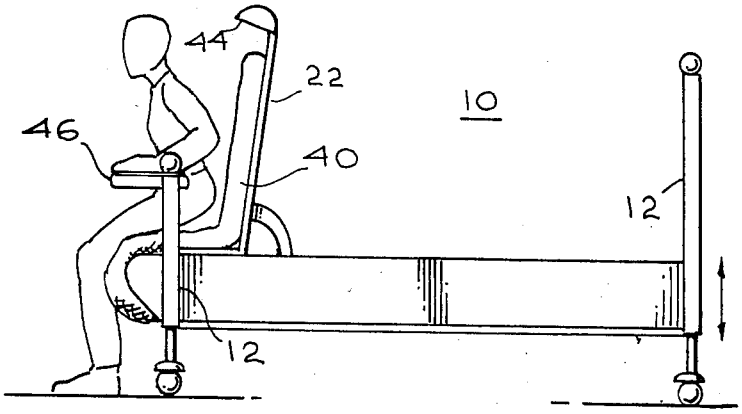
FIG. 4 shows the device of FIG. 3 in a partially raised position.
Figure 5:
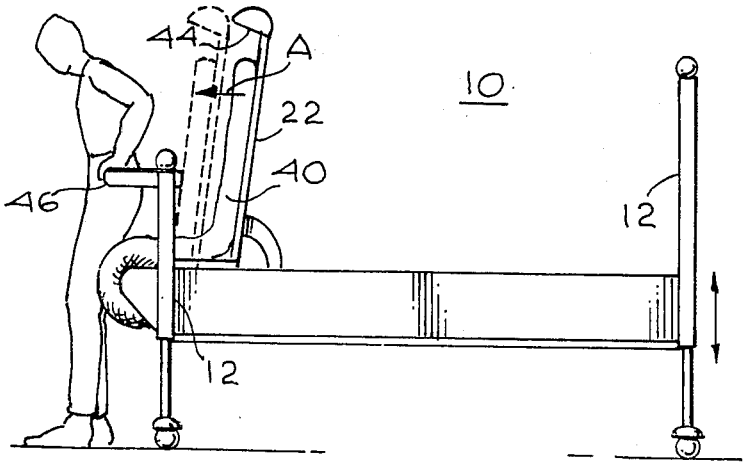
FIG. 5 shows the device of FIG. 3 in a fully raised position.

FIGS. 3–5 are provided to show the manner in which the convertible bed may be used to raise a patient to a standing position unassisted. These figures show the device in the converted chair configuration. In FIG. 3, the bed is shown fully lowered to a level of conventional chair height for the person seated therein. The arm rests 46 are padded and the mattress 40 is held in place so that the chair configuration affords the comfort of any easy chair. FIG. 3 also shows a hospital table 36 of the conventional type having a horizontal panel 37 cantilevered from a vertical post 38 mounted on a caster pedestal 39, in position for use by the patient in reading, writing or eating meals.

Figure 11:
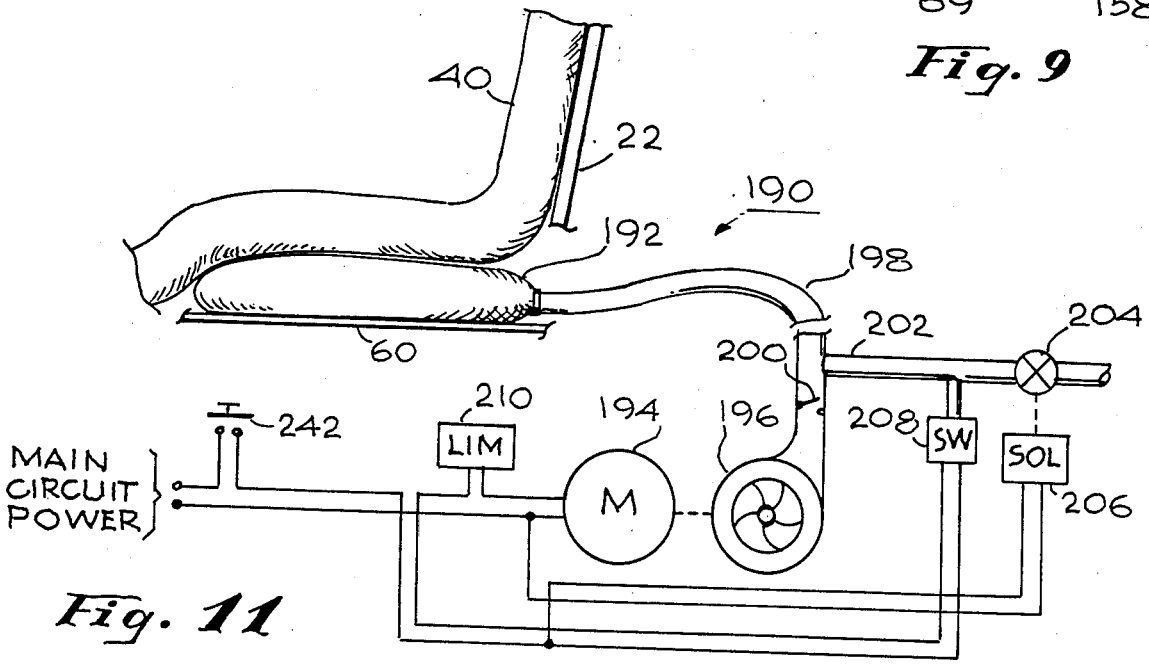
FIG. 11 is a schematic diagram representing another feature incorporated in the convertible bed of FIG. 1.

When the patient wishes to rise from the armchair configuration shown in FIG. 3, he activates the switch 47 on the arm rest 46 to raise the bed by causing the legs 12 to extend from the telescoped position, at the same time using the arm rests 46 to assist him in standing erect. FIG. 4 shows the convertible bed with the legs 12 partially extended and the patient beginning to arise from the chair configuration. FIG. 5 shows the legs 12 essentially fully extended with the patient about to stand fully erect. In transitioning from the position of FIG. 4 to the position of FIG. 5, the patient may activate the mechanism driving the carriage 30 toward the foot of the bed to cause the chair back 22 and mattress 40 to move in the direction of the arrow A and assume the position shown in phantom outline in FIG. 5. Thus the chair continues to provide back support for the patient as it raises him to the standing positon. In accordance with a further aspect of the present invention, further assistance may be afforded the patient through the use of an inflatable pillow, details of which are shown in FIG. 11 and described hereinbelow.

To enable the patient to assume a sitting position, without dependence upon attendants, from standing erect, the apparatus 10 is controlled by switch 48 to operate in the sequence of FIGS. 5-4-3 after which, if the patient desires, the chair configuration can be converted into the hospital bed configuration of FIG. 1 or FIG. 2.

Certain of the elements making up the convertible bed as shown in the plan view of FIG. 6 are shown partially broken away for clarity of illustration; only one of the arm rests 46 is shown and the upper body portion 22 of the upper frame 20 is omitted. The main bed frame 16 generally comprises a pair of outer siderails 50 and a pair of inner rails 52 joined together in a rigid box-like construction by a head rail 54 and a foot rail 56. The cylindrical roller 34 is mounted for rotation in bearings affixed to the siderails 50. The arm rests 46 extend from the adjacent legs 12 via brackets 58. The rails making up the main bed frame are formed of U-shaped channel iron. The lower interior channel surfaces provide support tracks for the longitudinally movable sections of the bed 10.

Figure 9:
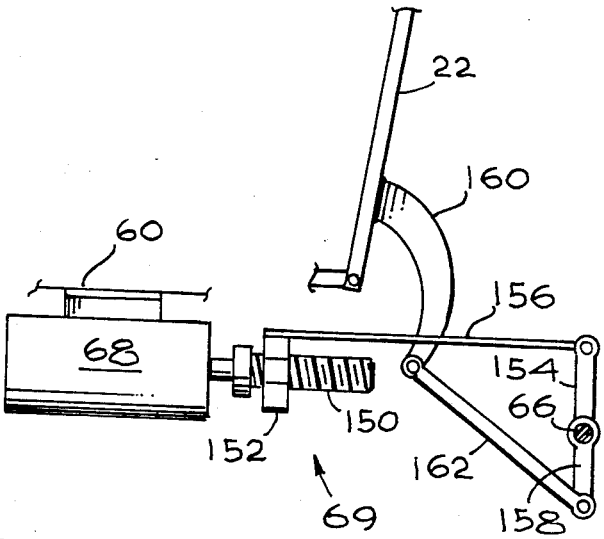
FIG. 9 is a schematic side elevation of another particular portion of the device shown in FIG. 6.

The carriage 30 is supported on these channel surfaces **62*a* and includes a transverse plate 60 extending between a pair of longitudinal carriage frame members 62, 63 which serve as guides for the longitudinal movement of the carriage and mount the supporting rollers or wheels 31 (FIG. 7). Extending between the movable frame members 62 and mounted for longitudinal movement therewith is a cross shaft 66 which is part of the mechanism for elevating the upper body portion/chair back 22. Details of this mechanism are shown in FIG. 9. This mechanism includes a motor 68 and worm gear 69, the motor being mounted to the plate 60**.

The mechanism for raising and lowering the bed is conventional and need not be shown in detail. The head raising mechanism comprises a motor 70 mounted to one of the inner rails 52 and coupled via a worm arrangement within the housing 72 to a pair of cables 74. The coupling within the housing 72 is supported from the adjacent inner rail 52 by means of brackets 76. The cable 74 extend over pulleys 78 and other pulleys (not shown) within the head rail 54 and the legs 12 at the head of the bed. Activation of the reversible motor 70 moves the cables 74 to raise or lower the head of the bed. A corresponding mechanism driven by a motor 80, also mounted to the inner rail 52, is provided for controlling the elevation of the foot of the bed.

The plurality of slats 32 are joined to each other at their respective opposite ends and to the side frame members 62 of the carriage 30 by links of a pair of sprocket chains 90 which move within the side channels 50, one side channel being broken away to show the chain in the lower right-hand corner of the figure. These chains 90 extend over sprockets 92 mounted on opposite ends of a cross shaft 94 which is supported in bearings (not shown) in the inner rails 52. The shaft 94 is coupled to be driven by a motor 96 which is mounted on the head rail 54. The coupling between the motor 96 and the cross shaft 94 is via respective sprockets 98, 99 and a sprocket chain 100.

As is better shown in the schematic drawing of FIG. 7, the chain 90 is coupled to the carriage 30 at point A and to the outermost of the slats 32 at point B. Rotation of the cross shaft 94 and sprocket 92 drives the chain 90 in one direction or the other, thereby driving the slats 32 over the roller 34 and moving the carriage 30 on its supporting rollers or wheels 31 either toward the foot of the bed or toward the head, as desired to convert the bed between a chair configuration and a bed configuration.

Figure 8:
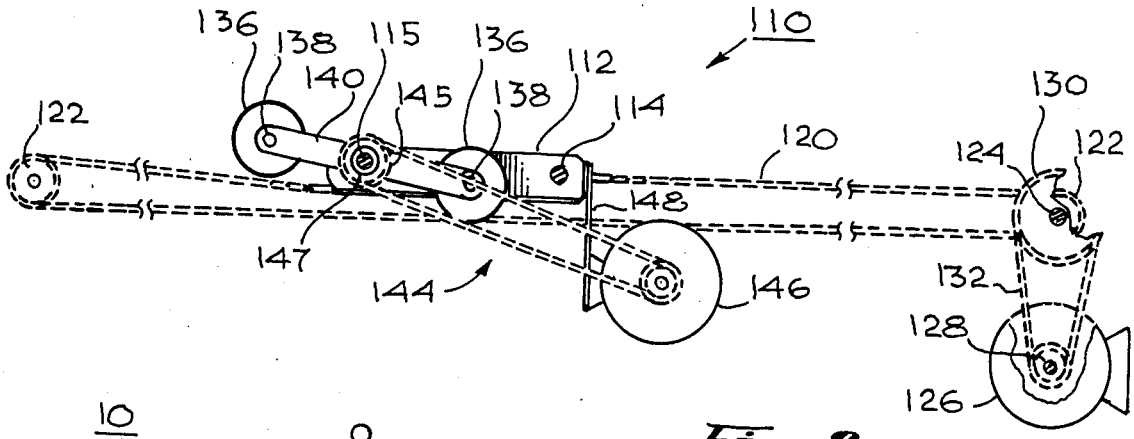
FIG. 8 is a schematic side elevation showing details of a particular portion of the device as shown in FIG. 6.

Referring again to FIG. 6, and also to FIG. 8 which is a side elevational view showing the structural details of a particular spinal massage apparatus which is incorporated in the convertible bed of the present invention, the massage apparatus 110 is shown mounted between the inner rails 52 for longitudinal movement generally along the upper body portion (hips to neck) of a patient lying in the bed 10.

The massage apparatus 110 is in the form of a carriage comprising a pair of opposed side plates 112 having cross shafts 114, 115, on which are mounted wheels 116 which ride on the lower inner surfaces of the channel rails 52. Longitudinal movement of the apparatus 110 is controlled by sprocket chains 120 which extend about sprockets 122 mounted on cross shafts 124 which are mounted in bearings in the inner rails 52 at positions near the head and hips, respectively, of a patient reclining in the bed 10. A reversible motor 126 is mounted on the head rail 54 and is coupled to the cross shaft 124 by way of sprockets 128, 130 and intercoupled sprocket chain 132.

A pair of massaging rollers 136 are mounted for rotation on respective shafts 138 that are supported in side plates 140. The side plates 140 are affixed to the cross shaft 115 such that as the cross shaft 115 rotates, the entire assembly of side plates 140 and rollers 136 rotates about the cross shaft 115, causing the rollers 136 in succession to roll along the underside of the mattress and thereby provide a massage of the adjacent portion of the body of the patient reclining in the bed. The cross shaft 115 and related rotating assembly are driven by a sprocket and chain arrangement 144 from a motor 146 mounted on a bracket 148 extending between the side plates 112. In operation, both motors 146 and 126 are activated together, so that the massage apparatus 110 moves back and forth longitudinally as the roller assembly 136, 140 rotates to provide the desired massage.

The massage apparatus 110 also includes a clutching arrangement which is effective, when the motor 146 is de-energized, to permit the massage assembly 136, 140 to assume a generally horizontal position, thereby preventing the massage apparatus from projecting upward against the mattress when the drive motor 146 is de-energized. An electric clutch 147 engages the drive from sprocket 145 of the drive arrangement 144 to the shaft 115. The clutch 147 is connected in parallel with the circuit to the motor 146 so that when the motor stops, the de-energized clutch 147 disengages the shaft 115 from the sprocket 145 and allows the rollers 136 to rotate to a generally horizontal plane.

FIG. 9 is a side elevational view, partially broken away, illustrating details of the mechanism for raising and lowering the upper body portion of the movable bed frame. This includes a drive motor 68, mounted on the cross plate 60 of the carriage 30 for longitudinal movement therewith, and a worm drive arrangement 69 comprising a threaded worm shaft 150 and mating coupler 152. A pair of lever bars 154 are affixed to the cross shaft 66, and the outer ends of the levers 154 are coupled to the collar 152 of the worm drive arrangement via links 156. Another pair of lever bars 158 are also mounted on the shaft 66 and are coupled to the upper body portion 22 of the movable bed frame via brackets 160 and turnbuckle links 162. With this arrangement, activation of the reversible motor 68 drives the collar 152 along the threaded worm shaft 150, thereby causing the bed frame portion 22 to be pivoted between the position shown, corresponding to elevation of the upper body portion to serve as a chair back in the chair configuration and a horizontal attitude in the bed configuration shown in FIG. 1.

Figure 10:
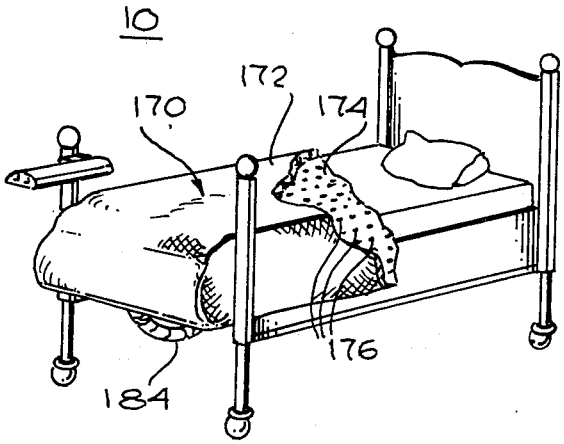
FIG. 10 is a perspective view of the bed illustrating a further feature of the convertible bed of the present invention.

FIG. 10 illustrates a coverlet 170 which may be used in conjunction with a further feature of the convertible bed of the present invention. The coverlet 170 is fabricated of light sheet material comprising an upper layer 172 and a lower layer 174 which are joined together around the edges to form a bag. Within the coverlet are a multiplicity of ties between the two layers 172, 174, suitably distributed for uniformity, which insure that the two layers are spaced close together, for example about two or three inches, when the coverlet is inflated. The upper layer 172 is substantially impervious to air, with the lower layer 174 is porous, being provided with a plurality of perforations 176 which permit air to flow freely from the space between the two layers 172, 174 to the vicinity of the patient's body underneath the coverlet. The bed 10 is equipped with a motor 180 and blower 182 mounted on one of the siderails 16 (see FIG. 6). A large flexible hose 184 extends from the outlet of the blower 182 to the foot of the coverlet 170, communicating with the space between the two layers 172, 174 so that air from the blower 182, conveyed by the tube 184, is introduced into the inner space of the coverlet 170, where it passes through the apertures 176 to provide heating or cooling for the bed patient. The air from the blower 182 may be heated or cooled, as desired, by means (not shown) to maintain a comfortable temperature for the patient. The motor 180 and blower 182 may also be used in order to propel ambient air, for the comfort of the patient. The coverlet 170, being made of sheet material, is substantially lighter in weight than coverlets presently in use which are either an electric blanket or a plurality of blankets. There are no electric wires in the coverlet so the potential hazard of an electric blanket is avoided. Furthermore, coverlet 170 is constructed of readily washable material and therefore contributes to the maintenance of better sanitary conditions than are practiced with conventional blankets that are generally used repeatedly without washing or dry cleaning from one patient to another.

Apparatus for providing a further feature in accordance with the present invention is more particularly shown in FIG. 11. The apparatus 190 of FIG. 11 is for the purpose of inflating a pillow 192 which is situated on the cross plate 60 of the carriage 30 and may be placed either under or on top of the mattress 140. The arrangement 190 comprises a motor 194 coupled to a blower or compressor 196, both of which are mounted to a siderail 16 of the bed 10 (see FIG. 6). The outlet of the blower 196 is coupled to the inflatable pillow 192 via a tube 198. The outlet of the blower 196 includes a check valve 200 and is also coupled to a bypass tube 202 which has coupled to it a normally open valve 204, controlled by solenoid 206, and a pressure sensing switch 208. The electrical power switch to the motor 194 includes a single pole, single throw switch 242 for connecting the motor to main circuit power and to a limit switch 210.

The control switch 242 is located on the control console (FIG. 12) so that the motor 194 may be controlled therefrom. Energizing the motor 194 drives the blower 196 to pressurize the outlet passages including the tube 198 to inflate the pillow 192. This also activates the solenoid 206 to close the bypass valve 204 so that the pillow 192 may be inflated. Switch 208 is set to open the motor circuit when the pressure at the outlet of the blower 196 reaches a level of approximately one pound per square inch. Thus, when that preset pressure is reached at the outlet of the blower 196, the circuit to the motor is de-energized so that the pillow 192 cannot be over-inflated. However, as long as the control switch 242 is closed, the solenoid 206 remains energized so that the outlet valve 204 is closed. Check valve 200 also closes under this condition and the pillow 192 remains inflated. If the switch 242 is opened, the solenoid 206 is de-energized and the normally open valve 204 then permits the pillow to deflate, the air passing outwardly through the valve 204 and the exit tube opening. The limit switch 210 is normally closed, but is physically positioned to be activated by movement of the carriage 30 so that the circuit to the motor 194 is disabled whenever the carriage 30 is in the bed position. When the carriage 30 is in the position of the chair configuration, the patient can control the pillow 192 to provide more comfortable support than is afforded with the mattress 40 alone when he is sitting in the chair and also to provide assistance in arising from the chair, as described hereinabove.

Figure 12:
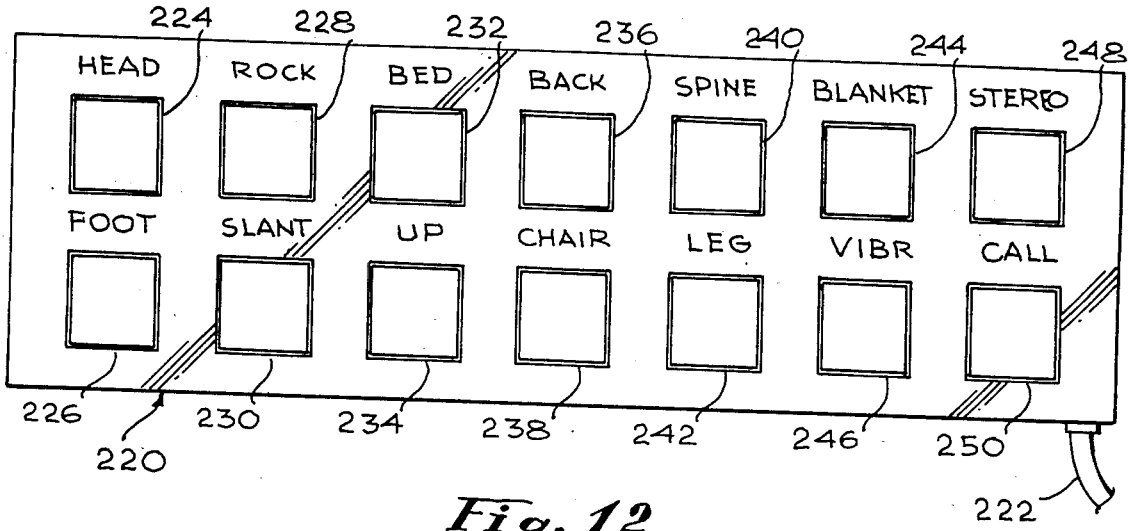
FIG. 12 is a plan view of a control console for the convertible bed of FIG. 1.

FIG. 12 illustrates a control console 220 which is associated with the convertible 10. The console 220 includes a plurality of switches connected to various related motors and other equipment mounted on the bed frame and the like via a cable 222. As indicated in FIG. 12, the switches of the control console 220 enable the patient to control the following functions when the designated switch is activated:

| Switch No. | Function |
|---|---|
| 224 "HEAD" | Elevates the head of the bed. |
| 226 "FOOT" | Elevates the foot of the bed. |
| 228 "ROCK" | Slowly rocks the bed by alternately raising and lowering the head and foot. |
| 230 "SLANT" | Raises the foot of the bed to a predetermined level. |
| 232 "BED" | Drives movable frame to the bed configuration. |
| 234 "UP" | Raises bed. |
| 236 "BACK" | Raises upper body portion of frame. |
| 238 "CHAIR" | Drives movable frame to chair configuration. |
| 240 "SPINE" | Energizes spinal massage system. |
| 242 "LEG" | Inflates pillow under seat. |
| 244 "BLANKET" | Inflates coverlet. |
| 246 "VIBR." | Energizes auxiliary message. |
| 248 "STEREO" | Controls associated stereo system. |
| 250 "CALL" | Rings nurse's station. |

It will be understood that the various switches of the control console 220 are connected in circuitry with the various drive motors and associated equipment 10. In this manner, the bed 10 can be fully controlled by a patient, whether in the reclining or sitting position, or by other personnel.

It will be further understood that the various movable portions of the bed are equipped with appropriate limit switches, such as the limit switch 242 in the sub-system shown in FIG. 11, to disable or reverse a drive motor when a particular limit of travel is reached. Thus, for example, limit switches are provided near the head and foot of the bed to disable the drive motor for the carriage 30 whenever the carriage reaches the position for the chair configuration or the position for the bed configuration. Similarly, reversing limit switches are provided at the limits of travel for the spine massage subsystem of FIG. 8, thereby causing the carriage of that system to stop and reverse direction whenever the position of the hips or neck is reached. Limit switches may also be provided to de-energize the motors 70 and 80 which control the raising and lowering of the bed and the motor 68 which controls the elevation angle of the upper body frame 22. This enumeration of limit switches which may be employed in the drive circuitry of the various motors, etc., associated with the bed 10 is merely by way of example, not limitation. Others may be incorporated as deemed appropriate or desired.

Figure 13:
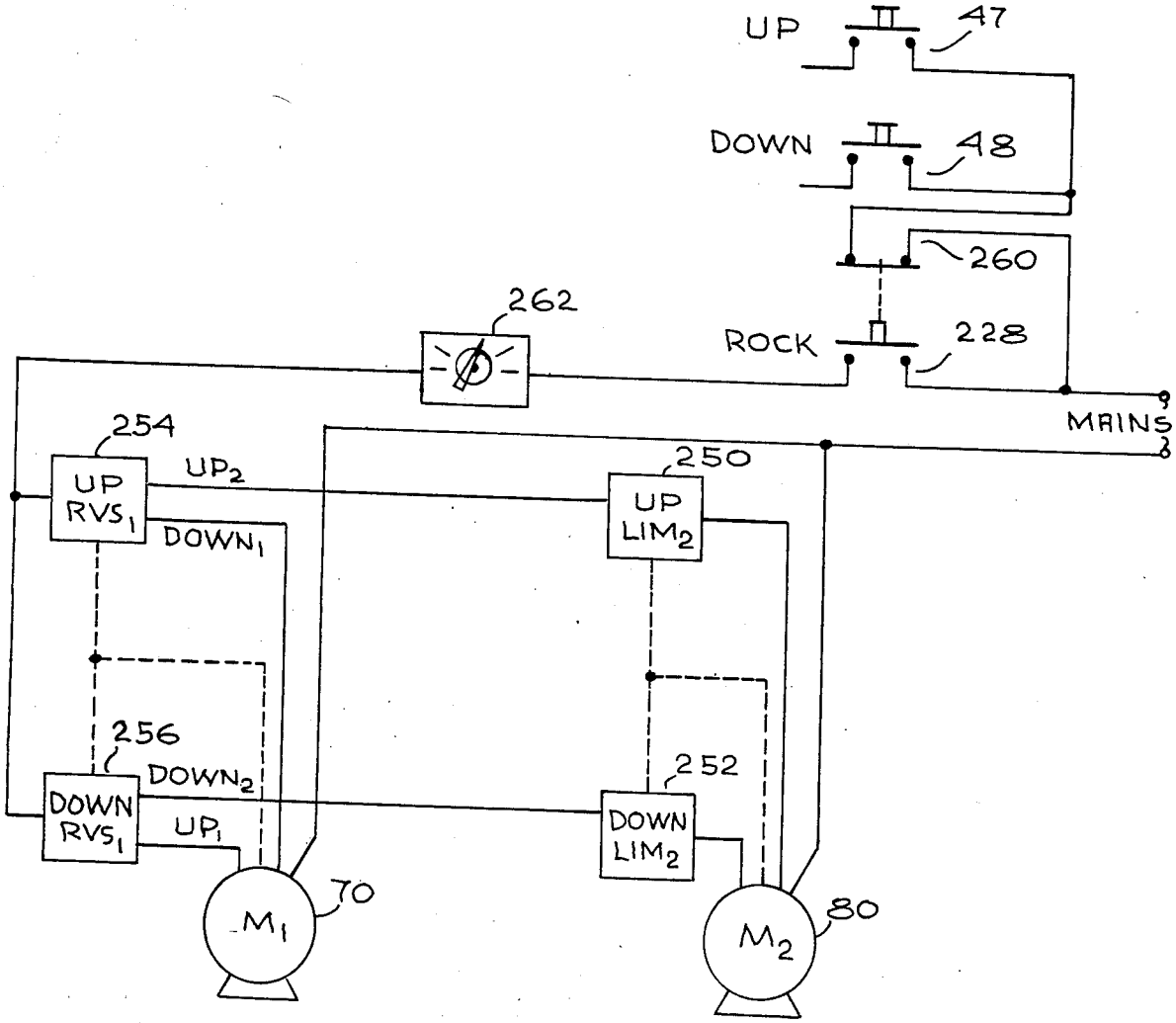
FIG. 13 is a schematic circuit diagram illustrating still another feature of the convertible bed of FIG. 1.

As an example, a circuit for rocking the bed is shown in FIG. 13. This shows the two motors 70 and 80 which provide independent control of the height of the head and foot of the bed, respectively. These are reversible motors and their respective circuits are provided with switches to de-energize the motors at the limits of their up and down travel. In the rocking circuit of FIG. 13, the UP limit switch 250 and DOWN limit switch 252 of the motor 80 are intercoupled with a pair of reversing switches, UP reversing switch 254 and DOWN reversing switch 256, and the ROCK switch 228 on the control panel of FIG. 12. Limit switches 250, 252 are normally closed and are opened by the elevating mechanism driven by the motor 80 at the corresponding limits of travel. The reversing switches 254, 256 are activated by the motor 70 at the limit of travel of the drive mechanism associated with the motor 70 and are mechanically interlocked so that only one of the switches can be closed at any given time. The circuit of FIG. 13 also includes an interlock switch 260 which is mechanically coupled to the ROCK switch 228 and is in circuit with the UP switch 47 and DOWN switch 48 that are mounted in one of the arm rests 46 (see FIG. 1). The circuitry connected to the switches 47, 48 is omitted for simplicity.

To activate the rocking motion, the ROCK switch 228 is depressed. This supplies power from the mains to one side of the reversing switches 254, 256. Assuming the UP reversing switch 254 is closed, the $UP_2$ and $DOWN_1$ lines are energized to cause the motor 70 to drive its elevating mechanism in a downward direction while the motor 80 drives its elevating mechanism upward. When the head of the bed, driven by motor 70, reaches its downward limit, reversing switch 256 is closed and reversing switch 254 is opened. Power is now supplied to the $DOWN_2$ and $UP_1$ lines to drive the head of the bed upward while the foot is lowered. The connections through the limit switches 250, 252 associated with the driving mechanism of motor 80 insure that the mechanism driving the foot of the bed will not move against its travel limit, should the head of the bed be lagging in its travel. The speed of the motors 70, 80 is such that the rocking motion completes a cycle in approximately 10 to 15 seconds, thus providing very gentle, soothing sensation to the patient in the bed. A timer 262 may be set to shut off the rocking circuit after a preset interval of from 5 to 15 minutes.

Thus, there has been shown and described hereinabove one preferred arrangement of a convertible hospital bed in accordance with the present invention. The principal objective of this arrangement is to provide a convertible bed system which can be controlled in various configurations by the patient alone without the necessity for signalling an attendant each time the bed is to be raised or lowered, spinal massage provided, coverlet temperature adjusted, etc. Furthermore, the convertible hospital bed of my invention enables the bed to be converted into a comfortable armchair without requiring that the patient move out of the bed. Furthermore, this convertible bed arrangement enables an ambulatory patient, who might be too weak to get out of bed without assistance, to control the elevation of the chair configuration in which he is sitting so that he can rise from the chair unaided.

Although there have been described above specific arrangements of a convertible hospital bed in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A convertible bed comprising:

a main frame supported on legs and extending generally between the head and foot of the bed;

a movable frame supported on the main frame and movable longitudinally relative thereto between a first position defining a bed configuration and a second position defining a chair configuration;

an upper body portion of the movable frame which is pivotably mounted to the movable frame approximately midway between opposite ends thereof;

selectively operable drive means for controlling the position of the upper body portion between a generally horizontal attitude in the bed configuration and a nearly vertical attitude in the chair configuration, whereby the upper body portion serves as a chairback in the chair configuration; and selectively operable means for driving the movable frame longitudinally between said first and said second positions, said last-mentioned means including means for drawing the foot end of the movable frame back under the bed in the chair configuration.

2. The convertible bed of claim 1 wherein the foot portion of the movable body frame is flexible and further including a roller mounted at the foot of the bed to guide the flexible portion of the movable frame between a position withdrawn under the bed when the movable frame is in the position of the chair configuration and a flat position along the foot of the bed when the movable frame is in the position of the bed configuration.

3. The convertible bed of claim 2 wherein the movable frame comprises a movable carriage and wherein the foot portion of the movable frame comprises a plurality of slats extending transversely between opposite sides of the bed, said slats being flexibly coupled together and to an adjacent end of the carriage by flexible tensile members extending over the roller and back underneath the bed.

4. The convertible bed of claim 3 wherein the flexible tensile members extend underneath the bed along substantially the full length thereof, over rotatable drive members adjacent the head of the bed, and back to the vicinity of the movable carriage, the remaining ends of the tensile members being secured to the remaining end of the carriage.

5. The convertible bed of claim 4 wherein the movable carriage includes a plurality of wheels mounted for rolling along upper supporting surfaces of the main frame, and wherein the tensile members comprise a pair of sprocket chains extending along opposite sides of the bed and over the roller at the foot of the bed, the slats being coupled to individual links in the respective sprocket chains at opposite ends of the slats.

6. The convertible bed of claim 1 wherein the main frame comprises a pair of siderails and a pair of inner rails secured to a pair of cross rails in a box-like configuration and further including a spinal massage apparatus mounted on the inner rails and selectively movable longitudinally thereof to massage the back of the patient in the bed.

7. The convertible bed of claim 6 wherein the massage apparatus comprises a pair of opposed side frame members supported by wheels from the inner rails, a plurality of cross members extending between the side frame members, one of said cross members comprising a rotatable shaft to which are mounted a pair of frame plates supporting opposed rollers in an assembly which is rotatable about the cross shaft to direct the rollers in succession against an adjacent region of a mattress on the bed, and means for selectively driving the rotatable assembly.

8. The convertible bed of claim 7 further including means for selectively driving the massage apparatus back and forth longitudinally along a selected portion of the bed while the rollers are driven in rotation about the supporting cross shaft to distribute the massaging force applied from the rollers against the mattress along a portion of the bed corresponding to that extending between the hip and neck areas of a patient in the bed.

9. The convertible bed of claim 8 wherein the selectively driving means for the massage apparatus comprise a pair of sprocket chains extending longitudinally along the inner rails between sprockets on a pair of cross shafts mounted respectively adjacent the foot portion and the head portion of the bed, opposite ends of the sprocket chains being coupled to the side frames of the apparatus.

10. The convertible bed of claim 9 wherein the means for selectively driving the rotatable massage assembly includes a drive motor which is mounted on a bracket coupled between the side frame members for movement longitudinally with the massage apparatus and a sprocket arrangement extending between the motor and the cross shaft for driving the cross shaft and rollers affixed thereto to rotate.

11. The convertible bed of claim 10 further including selectively engageable coupling means between the drive motor and the cross shaft for releasing the massage assembly to rotate to a predetermined rest position away from contact with the mattress when the massage assembly drive motor is de-energized.

12. The convertible bed of claim 11 wherein the coupling means comprise an electric clutch coupling the sprocket arrangement to the assembly cross shaft.

13. The convertible bed of claim 1 further including separate means for elevating the head and foot of the bed independently and means for energizing a selected one of said separate means to cause the bed to slant with the foot elevated higher than the head portion.

14. The convertible bed of claim 13 further including means for controlling said separate elevating means to rock the bed by alternately raising and lowering the head and foot of the bed, said controlling means including means for energizing the head and foot elevating means in opposed synchronism with each other.

15. The convertible bed of claim 1 wherein said legs comprise telescoping sections to permit the legs to be extended and retracted for raising and lowering the bed.

16. The convertible bed of claim 1 further including a selectively operable motor and blower coupled to provide a volume of air at low pressure to a coverlet on the bed for aerating the space underneath the coverlet.

17. The convertible bed of claim 16 further including a flexible hose extending between the blower and the coverlet.

18. The convertible bed of clam 1 further including a pair of arm rests respectively positionable adjacent the legs at the foot of the bed for use by a patient when the bed is in the chair configuration.

19. The convertible bed of claim 18 further including means for selectively varying the elevation of the foot of the bed to provide assistance to the occupant of the chair configuration in raising himself to a standing erect position.

20. The convertible bed of claim 19 wherein the longitudinal driving means is operable to drive the movable frame beyond said second position as the foot of the bed is being elevated to further assist the occupant to stand erect.

21. The convertible bed of claim 19 further including an inflatable pillow mounted on the seat of the convertible bed in the chair configuration and means for selectively inflating the pillow to assist the patient in rising to a standing position as the chair is elevated.

22. The convertible bed of claim 21 wherein the pillow inflating means comprises a selectively operable source of compressed air, means for supplying the compressed air to the pillow, and means for sensing the pressure of air in the pillow and disabling the pressurized air source on reaching a predetermined pressure.

23. The convertible bed of claim 22 further including selectively operable means for opening a relief passage from the pillow to permit the pillow to deflate.

* * * * *